US007452203B2

(12) United States Patent
Laux et al.

(10) Patent No.: US 7,452,203 B2
(45) Date of Patent: Nov. 18, 2008

(54) STRATIFIED STAGING IN KILNS

(75) Inventors: Stefan Laux, Williamsville, NY (US); Lawrence E. Bool, III, East Aurora, NY (US)

(73) Assignee: Praxair Technology, Inc., Danbury, CT (US)

( * ) Notice: Subject to any disclaimer, the term of this patent is extended or adjusted under 35 U.S.C. 154(b) by 115 days.

(21) Appl. No.: 11/581,514

(22) Filed: Oct. 16, 2006

(65) Prior Publication Data

US 2008/0090194 A1 Apr. 17, 2008

(51) Int. Cl.
*F27B 7/36* (2006.01)

(52) U.S. Cl. ..... 432/111; 432/13; 432/103

(58) Field of Classification Search ..... 432/13, 432/14, 58, 103, 105, 108, 109, 111; 110/246
See application file for complete search history.

(56) References Cited

U.S. PATENT DOCUMENTS

| | | | | |
|---|---|---|---|---|
| 3,074,707 | A | 1/1963 | Humphries et al. | |
| 3,397,256 | A | 8/1968 | Paul et al. | |
| 3,404,199 | A * | 10/1968 | Hoffmann | 432/14 |
| 3,488,700 | A | 1/1970 | Iken et al. | |
| 5,007,823 | A | 4/1991 | Mayotte et al. | |
| 5,523,060 | A * | 6/1996 | Hogan | 422/184.1 |
| 5,572,938 | A * | 11/1996 | Leger | 110/346 |
| 5,769,624 | A | 6/1998 | Luxton et al. | |
| 6,077,072 | A * | 6/2000 | Marin et al. | 432/105 |
| 6,116,896 | A | 9/2000 | Joshi et al. | |
| 6,168,425 | B1 * | 1/2001 | Fujinami et al. | 432/58 |
| 6,318,278 | B1 * | 11/2001 | Dugue et al. | 110/348 |
| 6,375,456 | B1 | 4/2002 | Dugue et al. | |
| 6,957,955 | B2 | 10/2005 | Kobayashi et al. | |
| 7,229,281 | B2 * | 6/2007 | Hansen et al. | 432/118 |
| 2001/0044089 | A1 * | 11/2001 | Marin et al. | 432/14 |
| 2002/0172907 | A1 * | 11/2002 | Tseng et al. | 432/14 |

FOREIGN PATENT DOCUMENTS

EP 1155731 A1 11/2001

OTHER PUBLICATIONS

Hoyle, et al., Use of Oxygen to Enhance Kiln Burning at Mountain Cement Company, Rock Products International Cenent Seminar, Miami Beach FL, Nov. 27 to Dec. 1, 1994.

Coveney, et al., "Oxygen Enrichment for Improvements in Emissions Control While Burning Waste Fuels", Portland Cement Association Meeting, Seattle, WA, Sep. 18 to 21, 1994.

Lawrence E. Bool III, NOx Reduction From A 44-MW Wall-Fired Boiler Utilizing Oxygen Enhanced Combustion, Combined Power Plant Air Pollutant Control MEGA Symposium, Wash. DC, May 2003.

* cited by examiner

*Primary Examiner*—Gregory A Wilson
(74) *Attorney, Agent, or Firm*—Donald T. Black

(57) ABSTRACT

In a kiln whose interior is heated by combustion with oxidant having a higher oxygen content than air, streams of staging oxidant are fed into the space between the combustion zone and the inner surface of the kiln, and the stoichiometric ratios and amounts of oxygen in the combustion zone and in the overall operation of the kiln are adjusted to provide control or reduction of NOx formation while maintaining or increasing productivity of the kiln.

18 Claims, 3 Drawing Sheets

STRATIFIED STAGING IN KILNS

FIELD OF THE INVENTION

The present invention relates to operation of kilns, and especially to modifications to improve the productivity of operations in kilns while maintaining control of undesirable emissions.

BACKGROUND OF THE INVENTION

Many industrial operations that require heating solid material to high temperatures are carried out in kilns, wherein the material is fed into a kiln and passed through the kiln while the material is exposed to heat generated by combustion of fuel and oxidant within the kiln. The rate at which material can be processed in kilns can be increased by combusting the fuel with oxygen-enriched air or commercial-purity oxygen. However, combustion with oxidant that has such an increased oxygen content can produce increased amounts of environmentally undesirable byproducts such as nitrogen oxides that threaten to exceed regulatory limits on such emissions.

There remains a need for techniques to improve kiln operations in a way that can increase productivity without causing undue amounts of emissions such as nitrogen oxides.

BRIEF SUMMARY OF THE INVENTION

One aspect of the present invention is a method for processing solid material comprising:

(A) combusting fuel and primary oxidant in a kiln in a combustion zone within said kiln which extends lengthwise along the longitudinal axis of the kiln from the base of the combustion zone toward its free end, wherein the stoichiometric ratio of oxygen to fuel in said combustion zone is 0.3 to 0.9;

(B) feeding a plurality of streams of staging oxidant into the kiln into the space between said combustion zone and the inner surface of said kiln in the direction extending from the base of the combustion zone to the free end of said combustion zone, along said longitudinal axis of the kiln, wherein said streams are fed at a sufficient velocity and orientation that the fraction of the staging oxidant that has been entrained into the combustion zone between the base of the combustion zone and any point along the direction of flow of the staging oxidant is equal to or less than the fraction of primary oxidant that has entered into the combustion between the base of the combustion zone and said point, whereby staging oxidant is entrained into said combustion and combusts therein with unburned fuel or products of incomplete combustion of said fuel;

wherein all oxygen entering said kiln from all sources constitutes 27.5 vol. % to 72.5 vol. % of all gas entering said kiln, and wherein the overall stoichiometric ratio of all oxygen entering said kiln to fuel entering said kiln is greater than 1.0 and not greater than 1.30; and (C) passing said solid material into, through, and out of said kiln while rotating the kiln so that the solid material passes along the length of the kiln from the point at which it enters the kiln to the point of its passage out of the kiln, wherein said solid material is exposed to heat of combustion of said fuel while it is passing through the kiln.

Another aspect of the present invention is a method for modifying a kiln for processing solid material comprising:

(A) providing a kiln in which fuel and primary oxidant having an oxygen content greater than 22 vol. % are combusted in a combustion zone within said kiln which extends lengthwise along the longitudinal axis of the kiln from the base of the combustion zone toward the free end of the combustion zone, and wherein solid material passes into, through and out of said kiln while said kiln is rotated so that the solid material passes along the length of the kiln from the point at which it enters the kiln to the point of its passage out of the kiln, wherein said solid material is exposed to heat of combustion of said fuel while it is passing through the kiln;

(B) adding a plurality of inlets proximate to the base of said combustion zone, between said combustion zone and the inner surface of said kiln;

(C) adjusting the feed of fuel and oxidant to said combustion zone so that the stoichiometric ratio of oxygen to fuel in said combustion zone is 0.3 to 0.9; and (D) feeding a plurality of streams of staging oxidant through said inlets into the kiln in the direction extending from the base of said combustion zone to the free end of said combustion zone, along said longitudinal axis of the kiln, wherein said streams are fed into the space between said combustion zone and the inner surface of said kiln, at a sufficient velocity and orientation that the fraction of the staging oxidant that has been entrained into the combustion zone between the base of the combustion zone and any point along the direction of flow of the staging oxidant is equal to or less than the fraction of primary oxidant that has entered into the combustion between the base of the combustion zone and said point, whereby staging oxidant is entrained into said combustion and combusts therein with unburned fuel or products of incomplete combustion of said fuel;

wherein all oxygen entering said kiln from all sources constitutes 27.5 vol. % to 72.5 vol. % of all gas entering said kiln, and wherein the overall stoichiometric ratio of all oxygen entering said kiln to fuel entering said kiln is greater than 1.0 and not greater than 1.30.

As used herein, the "combustion zone" is the region within the kiln in which combustion occurs and within which the temperature in any plane perpendicular to the axis of the kiln is within 90% of the peak flame temperature in that plane.

As used herein. "primary oxidant" is the gaseous matter containing oxygen that enters the combustion zone at its base and combusts with fuel fed to the combustion zone.

DETAILED DESCRIPTION OF THE INVENTION

The method of the present invention is useful in kilns for processing any of a variety of solid material. Various types of processing include one or more of the following: melting, and/or fusing, and/or causing chemical reaction and/or recombination. One preferred example of such processing is heating mixtures of the solid materials which, when melted and fused together and then pulverized, form cement; in such embodiments, the feed material comprises mixtures containing silica (such as sand), lime or limestone, and any of various types of clay. In these embodiments, the processing which the solid material undergoes includes melting, fusing and chemical recombination. Other examples of the processing of solid material in kilns in which the present invention is useful include coking kilns, in which petroleum coke is heated to a high temperature to drive off relatively volatile components thereof, and calcining operations such as lime kilns wherein calcium sulfate or calcium carbonate is heated to a high temperature to drive off oxides and produce lime. Another example is ore roasting, wherein material containing metal sulfides is heated to convert the sulfides to the oxides of the metal values present.

Figure 1:
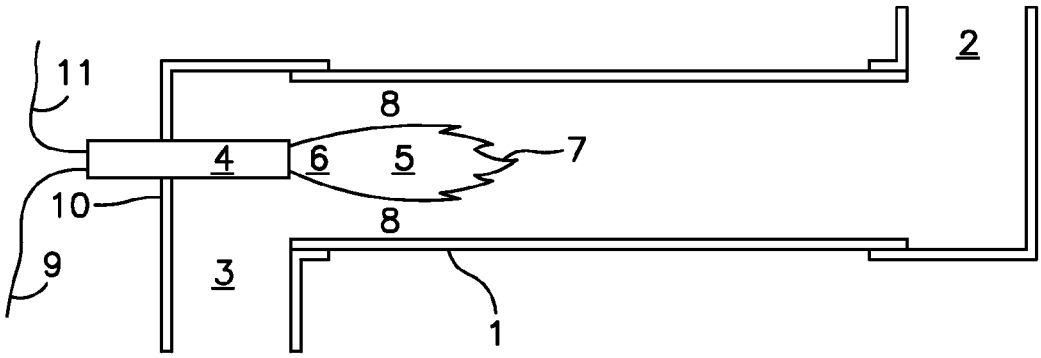
FIG. 1 (PRIOR ART)
FIG. 1 is a cross-sectional view of a kiln with which the present invention may be practiced, viewed along the lengthwise axis of the kiln.

The present invention is useful in kilns of the type illustrated in FIG. 1, but is not restricted to any specific particular kiln design. FIG. 1 illustrates generally kilns with which the present invention is useful.

Referring to FIG. 1, kiln 1 is a housing that has a lengthwise axis that is horizontal or, preferably, is inclined slightly off of the horizontal. Kiln 1 is rotatable about that lengthwise axis. Material to be treated in the kiln enters through feed end 2, passes through the interior of kiln 1, and exits from feed exit 3. As is well known in this field, the lengthwise axis of kiln 1 is inclined so that material fed into feed end 2 passes under the influence of gravity through the interior of kiln 1 toward feed exit 3 from which the material leaves the kiln. The kiln rotates slowly about its lengthwise axis, driven by a motor and associated gears or belts and controls, all of which are well known in this field. The length of the kiln, and the speed of rotation, provide suitable residence time for the material as it passes through the kiln and provides suitable tumbling action by which the material is exposed as desired to the heat that is generated within the kiln.

The kiln includes burner 4, at which combustion is maintained to establish combustion zone 5 within the kiln interior. Combustion zone 5 extends from its base 6, at burner 4, to free end 7 of combustion zone 5 further in the interior of the kiln. That is, combustion zone 5 extends lengthwise within the interior of kiln 1 along the lengthwise axis of the kiln. Burner 4 is preferably located so that it and combustion zone 5 are at all times the same distance from all inner surfaces of the kiln, or within about 5-10% of being the same distance from all inner surfaces of the kiln, the better to promote the uniform application of heat to the material passing through the kiln and the better to avoid fluctuations in the amount of heat provided to the inner surface of the kiln as the kiln rotates. Reference numeral 10 indicates an end plate (or cap or equivalent structure) provided at the end of the kiln at which burner 4 is located, to seal the kiln end against the ambient atmosphere and to provide structural support for burner 4 which typically protrudes through the end of the kiln into the interior of kiln 1.

Fuel is fed to burner 4 from a suitable source thereof (not depicted) by fuel feed line 9. Suitable fuels include gaseous hydrocarbons such as natural gas, methane, propane and mixtures thereof; liquid hydrocarbon such as fuel oil, gasoline, kerosene and mixtures thereof; and solid hydrocarbonaceous matter such as coal, petroleum coke, biomass, waste fuels, and mixtures thereof.

In conventional operation of many kilns, the oxygen necessary for combustion of the fuel that is fed into burner 4 is provided entirely by a combination of the oxygen that is provided to and fed through the burner, together with oxygen that is present in air that is drawn into the interior of the kiln through feed exit 3. The air that enters the kiln through feed exit 3 typically enters combustion zone 5 at or near its base 6. The oxygen that is provided to and fed through the burner may be supplied by a single stream which is represented by first feed line 11. This stream is typically air.

In the prevailing conventional mode of operation is that 100% and even more than 100% of the amount of oxygen required for complete combustion of the fuel enters into combustion with the fuel in combustion zone 5, and enters combustion zone 5 at or near the base 6 of the combustion zone. As stated above, this mode of operation may be satisfactory for some purposes, but the present invention improves on it.

The present invention employs some of the same apparatus illustrated in FIG. 1, but introduces modifications which result in improved productivity while maintaining or even reducing the amount of undesirable emissions such as nitrogen oxides.

Figure 2:
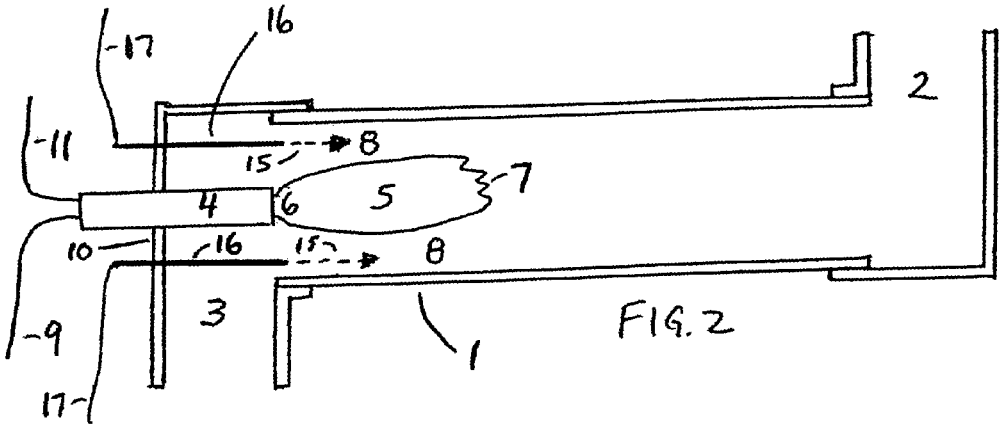
FIG. 2 is the cross-sectional view of the kiln depicted in FIG. 1 adapted for practice of the present invention.
Figure 3:
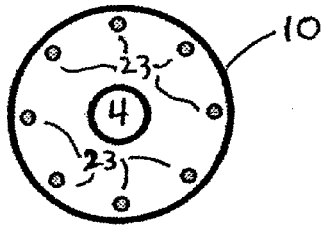
FIG. 3 is a cross-sectional view of the kiln of FIG. 2, viewed on a plane perpendicular to the lengthwise axis of the kiln.

Reference is now made to FIG. 2, in which reference numerals that appear in both FIGS. 1 and 2 have the meanings ascribed to them above in the discussion of FIG. 1. A plurality of streams 15 of staging oxidant are fed into the interior of kiln 1, each into the space 8 between combustion zone 5 and the inner surface of kiln 1. One representative, preferred arrangement of such streams is illustrated in FIG. 3, which is a view looking along the lengthwise axis of the interior of the kiln toward burner 4 and plate 10. There can be seen a plurality of inlets 23, each of which would be supplying a stream 15 of staging oxidant toward the viewer, into the interior of kiln 1, in the space 8 between combustion zone 5 and the inner surface of the kiln. Preferably the streams 15 should be situated with respect to each other so that at least one stream 15 is located on each side of an imaginary cross-sectional plane that contains the longitudinal axis of the kiln. The inlets 23 in FIG. 3 are so situated, in that any such imaginary plane intersects plate 10 in a diameter extending across plate 10 and passing through burner 4, and inlets 23 are situated on both sides of any such plane.

The streams 15 of staging oxidant can be provided in any of several different manners. One way is to provide a number of lances arrayed around the burner 4, each oriented to inject its stream of oxidant through an inlet 23 into space 8. Another way, in those embodiments in which the end of kiln 1 in which burner 4 is located is closed by plate 10 or similar structure, would be to drill a number of holes through that structure and then either feed the staging oxidant through the holes, or to pass lances through the holes into the interior of the kiln and then pass the staging oxidant through the lances into the kiln.

At least two streams 15 should be provided. Preferably, four to twelve streams 15 of staging oxidant should be adequate. The degree of spacing between streams 15 is not critical, but preferably the streams 15 should be spaced at fairly uniform distances from one another and fairly uniform distances from the inner surface of the kiln, the better to promote uniform staging of the combustion that is described herein. It is also preferred that the streams 15 are fed into space 8 near the inner surface of the kiln, and more preferably closer to the inner surface of the kiln than to the outer edge of combustion zone 5.

The staging oxidant is a gaseous stream having an oxidant content of more than 22 vol. %. The staging oxidant can be oxygen-enriched air, formed for instance by adding technically pure oxygen (by which is meant a gaseous stream containing at least 90 vol. % oxygen) to air. Alternatively, and preferably, the staging oxidant is preferably technically pure oxygen. The staging oxidant is fed through staging oxidant feed lines 17 from a suitable source of the staging oxidant.

The streams 15 of staging oxidant are fed into the space 8 within kiln 1 at a velocity, and at an orientation with respect to the combustion zone 5 (i.e. parallel to, or even angled away from, the longitudinal axis of the kiln), so that the staging oxidant stream flows in a direction lengthwise along the axis of the kiln for at least part of the length of combustion zone 5.

Staging oxidant is gradually entrained into the combustion zone, whereupon the oxygen in the staging oxidant then combusts with unburned fuel or with products of incomplete combustion of the fuel. The fraction of the staging oxidant that has been entrained into the combustion zone between the base of the combustion zone and any point along the direction of flow of the staging oxidant is equal to or less than the fraction of primary oxidant that has entered into the combustion between the base of the combustion zone and said point.

In accordance with this invention, the amount of oxygen provided to the combustion zone 5 is accordingly less than the amount of oxygen that would be required to completely combust all the fuel in the combustion zone. More specifically, the amount of oxygen entering into combustion zone 5 from all sources (that is, from feed streams of air, feed streams of oxygen-enriched air or of technically pure oxygen, as well as air entering into kiln 1 from feed exit 3) should comprise 30% to 90% and preferably 60% to 80% of the total amount of oxygen that would be required to completely combust all the fuel in combustion zone 5. In terms of the stoichiometric ratio, which is the ratio of oxygen present to the amount of oxygen that would have to be present to completely combust all fuel present, the oxygen in the combustion zone should represent a stoichiometric ratio of 0.3 to 0.9 and preferably 0.6 to 0.8. This reduction in the flow of combustion oxygen into combustion zone 5 can be achieved by reducing the flow rate of the gaseous streams containing oxygen that are fed to the burner, and/or by reducing the oxygen content of those streams.

Another aspect of the present invention is that sufficient oxygen should be present in the streams of staging oxidant that are fed as described herein so that the overall stoichiometric ratio within the kiln, based on all oxygen fed to the kiln from all sources including, streams fed through the burner, the streams of staging oxidant, and the oxygen present in air that enters the kiln through feed exit 3, as well as oxygen in air that enters the kiln from any other source, should be 1.03 to 1.30.

In accordance with the present invention, it is also been determined that oxygen entering into the kiln from all sources should comprise 27.5 vol. % to 72.5 vol. % of all gaseous streams entering into kiln 1, whether fed through feed lines or entering in the air that enters through feed exit 3 or from any other source.

Conforming with these several conditions provides an effective way for the kiln operator to continue to maintain the desired heating and processing of material fed through the kiln, and even to increase the throughput of such material, because of the high heat afforded by combustion using oxidant streams having a higher oxygen content than the oxygen content of air, while avoiding any increase in the production of nitrogen oxides that might otherwise be caused by simply feeding more air or more oxygen directly into combustion zone 5. That is, the method of the present invention, whether achieved by modification of a previously existing kiln, or by manufacture of a new kiln that is already equipped to carry out the method of the present invention, carries out combustion in a staged manner which provides satisfactory productivity and satisfactory control or reduction of emissions of nitrogen oxides from the kiln. The method of the present invention is useful for modifying existing kilns, and for operating kilns that as modified or as manufactured are already fitted with the necessary components for carrying out the method including the feeding of supplemental oxidant as described herein.

In another embodiment of the invention, "primary oxygen" as that term is used herein is also provided to the combustion zone in a stream of oxygen-enriched air having an oxygen content of 22 vol. % to 90 vol. %, or of higher purity oxygen containing at least 90 vol. % oxygen. This stream is preferably fed through burner 4 and is supplied by second feed line 13. In such embodiments, first feed line 11 preferably feeds air. In this embodiment, the conditions described herein with respect to the stoichiometric ratio in combustion zone 5, with respect to the overall stoichiometric ratio in the kiln, and with respect to the overall concentration of oxygen from all sources as a percentage of the total gas flow from all sources into the kiln, take into account the stream entering from line 13 as well as the other streams described above.

Figure 4:
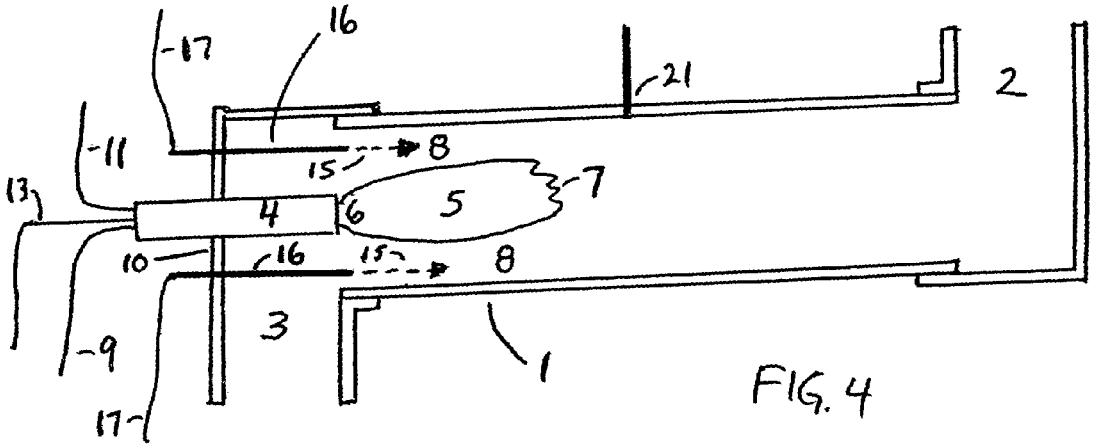
FIG. 4 is a cross-sectional view of the kiln of FIG. 2, showing an alternative embodiment.

Another optional embodiment of the present invention is depicted in FIG. 4. A small amount of material 21 is fed through the wall of the kiln into its interior at a point or points at or beyond the free end of combustion zone 5. The material comprises matter that participates in the combustion within the kiln. The material can be oxidant, preferably air or oxygen-enriched air containing more than 22 vol. % oxygen. When oxidant is fed in this manner, the amount of oxidant that would be fed in this embodiment should be such that the amount of oxygen fed in this way, together with the oxygen in the staging oxidant streams fed through inlets 23 and the oxygen otherwise entering the kiln as described herein, satisfy the aforementioned relationship with respect to the stoichiometric ratio in combustion zone 5, with respect to the overall stoichiometric ratio in the kiln, and with respect to the overall concentration of oxygen from all sources as a percentage of the total gas flow from all sources into the kiln. Alternatively, the material 21 fed to the kiln can be fuel, air, or gas containing less than 21 vol. % oxygen (such as flue gas).

What is claimed is:

1. A method for processing solid material comprising:

(A) combusting fuel and primary oxidant in a kiln in a combustion zone within said kiln which extends lengthwise along the longitudinal axis of the kiln from the base of the combustion zone toward its free end, wherein the stoichiometric ratio of oxygen to fuel in said combustion zone is 0.3 to 0.9;

(B) feeding a plurality of streams of staging oxidant into the kiln into the space between said combustion zone and the inner surface of said kiln in the direction extending from the base of the combustion zone to the free end of said combustion zone, along said longitudinal axis of the kiln, wherein said streams are fed at a sufficient velocity and orientation that the fraction of the staging oxidant that has been entrained into the combustion zone between the base of the combustion zone and any point along the direction of flow of the staging oxidant is equal to or less than the fraction of primary oxidant that has entered into the combustion between the base of the combustion zone and said point, whereby staging oxidant is entrained into said combustion and combusts therein with unburned fuel or products of incomplete combustion of said fuel;

wherein all oxygen entering said kiln from all sources constitutes 27.5 vol. % to 72.5 vol. % of all gas entering said kiln, and wherein the overall stoichiometric ratio of all oxygen entering said kiln to fuel entering said kiln is greater than 1.0 and not greater than 1.30; and (C) passing said solid material into, through, and out of said kiln while rotating the kiln so that the solid material passes along the length of the kiln from the point at which it enters the kiln to the point of its passage out of the kiln, wherein said solid material is exposed to heat of combustion of said fuel while it is passing through the kiln.

2. A method according to claim 1 where said primary oxygen is comprised of a stream of air that is fed through a burner into the base of said combustion zone, and a stream of air that enters said kiln through a passage through which said solid material passes out of said kiln.

3. A method according to claim 2 wherein said primary oxidant is further comprised of a gaseous stream having an oxygen content of at least 22 vol. % that is fed through said burner into the base of said combustion zone.

4. A method according to claim 3 wherein the oxygen content of said gaseous stream is at least 90 vol. %.

5. A method according to claim 1, further comprising feeding a stream of gaseous matter containing oxygen into the interior of said kiln through the wall of the kiln at a point at or beyond the free end of said combustion zone.

6. A method according to claim 5 wherein said stream of gaseous matter has an oxygen content less than 21 vol. %.

7. A method according to claim 5 wherein said stream of gaseous matter has an oxygen content greater than 22 vol. %.

8. A method according to claim 5 wherein said stream of gaseous matter is air.

9. A method according to claim 1, further comprising feeding a stream of fuel into the interior of said kiln through the wall of the kiln at a point at or beyond the free end of said combustion zone.

10. A method for modifying a kiln for processing solid material comprising:

(A) providing a kiln in which fuel and primary oxidant having an oxygen content greater than 22 vol. % are combusted in a combustion zone within said kiln which extends lengthwise along the longitudinal axis of the kiln from the base of the combustion zone toward the free end of the combustion zone, and wherein solid material passes into, through and out of said kiln while said kiln is rotated so that the solid material passes along the length of the kiln from the point at which it enters the kiln to the point of its passage out of the kiln, wherein said solid material is exposed to heat of combustion of said fuel while it is passing through the kiln;

(B) adding a plurality of inlets proximate to the base of said combustion zone, between said combustion zone and the inner surface of said kiln;

(C) adjusting the feed of fuel and oxidant to said combustion zone so that the stoichiometric ratio of oxygen to fuel in said combustion zone is 0.3 to 0.9; and (D) feeding a plurality of streams of staging oxidant through said inlets into the kiln in the direction extending from the base of said combustion zone to the free end of said combustion zone, along said longitudinal axis of the kiln, wherein said streams are fed into the space between said combustion zone and the inner surface of said kiln, at a sufficient velocity and orientation that the fraction of the staging oxidant that has been entrained into the combustion zone between the base of the combustion zone and any point along the direction of flow of the staging oxidant is equal to or less than the fraction of primary oxidant that has entered into the combustion between the base of the combustion zone and said point, whereby staging oxidant is entrained into said combustion and combusts therein with unburned fuel or products of incomplete combustion of said fuel;

wherein all oxygen entering said kiln from all sources constitutes 27.5 vol. % to 72.5 vol. % of all gas entering said kiln, and wherein the overall stoichiometric ratio of all oxygen entering said kiln to fuel entering said kiln is greater than 1.0 and not greater than 1.30.

11. A method according to claim 10 where said primary oxygen is comprised of a stream of air that is fed through a burner into the base of said combustion zone, and a stream of air that enters said kiln through a passage through which said solid material passes out of said kiln.

12. A method according to claim 11 wherein said primary oxidant is further comprised of a gaseous stream having an oxygen content of at least 22 vol. % that is fed through said burner into the base of said combustion zone.

13. A method according to claim 12 wherein the oxygen content of said gaseous stream is at least 90 vol. %.

14. A method according to claim 10, further comprising feeding a stream of gaseous matter containing oxygen into the interior of said kiln through the wall of the kiln at a point at or beyond the free end of said combustion zone.

15. A method according to claim 14 wherein said stream of gaseous matter has an oxygen content less than 21 vol. %.

16. A method according to claim 14 wherein said stream of gaseous matter has an oxygen content greater than 22 vol. %.

17. A method according to claim 14 wherein said stream of gaseous matter is air.

18. A method according to claim 10, further comprising feeding a stream of fuel into the interior of said kiln through the wall of the kiln at a point at or beyond the free end of said combustion zone.

* * * * *